United States Patent [19]

Baxter et al.

[11] Patent Number: 4,546,965

[45] Date of Patent: Oct. 15, 1985

[54] MOUNTAIN CLIMB AND SLIDE

[76] Inventors: Otela Baxter; George Spector, both of 233 Broadway Rm 3615, both of New York, N.Y. 10007

[21] Appl. No.: 591,601

[22] Filed: Mar. 20, 1984

[51] Int. Cl.[4] ..... A63B 21/00

[52] U.S. Cl. ..... 272/56.5 R

[58] Field of Search ..... 272/56.5 R, 1 R; D21/242, 243, 244, 245

[56] References Cited

U.S. PATENT DOCUMENTS

| | | | |
|---|---|---|---|
| D. 186,175 | 8/1959 | Ahrens | D21/244 |
| D. 239,845 | 5/1976 | Chase | D21/243 |
| 344,704 | 6/1886 | Whiteley | 272/56.5 R X |
| 796,159 | 8/1905 | Smolik | 272/56.5 R |
| 1,357,465 | 11/1920 | Mayer | 272/56.5 R |
| 1,526,680 | 2/1925 | Rees | 272/56.5 R |
| 2,012,195 | 8/1935 | Husted | 272/56.5 R |
| 2,620,185 | 12/1952 | Harding | D21/244 X |
| 3,263,994 | 8/1966 | Londgren | 272/56.5 R |
| 3,793,653 | 2/1974 | Brooks | 272/56.5 R X |
| 4,343,464 | 8/1982 | Dose | 272/56.5 R |

FOREIGN PATENT DOCUMENTS

| | | | |
|---|---|---|---|
| 549705 | 4/1932 | Fed. Rep. of Germany | 272/1 R |
| 2218560 | 10/1973 | Fed. Rep. of Germany | 272/56.5 R |
| 2355455 | 7/1974 | Fed. Rep. of Germany | 272/56.5 R |

*Primary Examiner*—Robert A. Hafer
*Assistant Examiner*—Arnold W. Kramer

[57] ABSTRACT

Apparatus for climbing and sliding is provided and consists of a hinge member connecting inner ends of a first panel and a second panel together and at least one brace member interconnecting outer ends of the panels so that the panels may be set up in inclined positions. The first panel has an irregular surface simulating mountains and a valley for a child to climb up while the second panel has a smooth surface for the child to slide down.

3 Claims, 4 Drawing Figures

MOUNTAIN CLIMB AND SLIDE

BACKGROUND OF THE INVENTION

The instant invention relates generally to play and exercise devices and more specifically it relates to an apparatus for climbing and sliding.

Numerous play and exercise devices have been provided in prior art that are adapted to amuse a child. For example U.S. Pat. Nos. 2,620,185; 3,032,343 and 3,263,994 all are illustrative of such prior art. While these units may be suitable for the particular purpose to which they address, they would not be suitable for the purposes of the present invention as heretofore described.

SUMMARY OF THE INVENTION

A principle object of the present invention is to provide an apparatus for climbing and sliding that will enable a child to climb, slide and crawl for the purpose of developing muscular ability and also to develop coordination between various parts of the body.

Another object is to provide an apparatus for climbing and sliding that may conveniently be used indoors as well as out of doors and which may be adapted to be stored away in a folded position.

An additional object is to provide an apparatus for climbing and sliding that has a first panel with an irregular surface simulating mountains and a valley for a child to climb up while a second panel has a smooth surface for the child to slide down.

A further object is to provide an apparatus for climbing and sliding that is simple and easy to use.

A still further object is to provide an apparatus for climbing and sliding that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
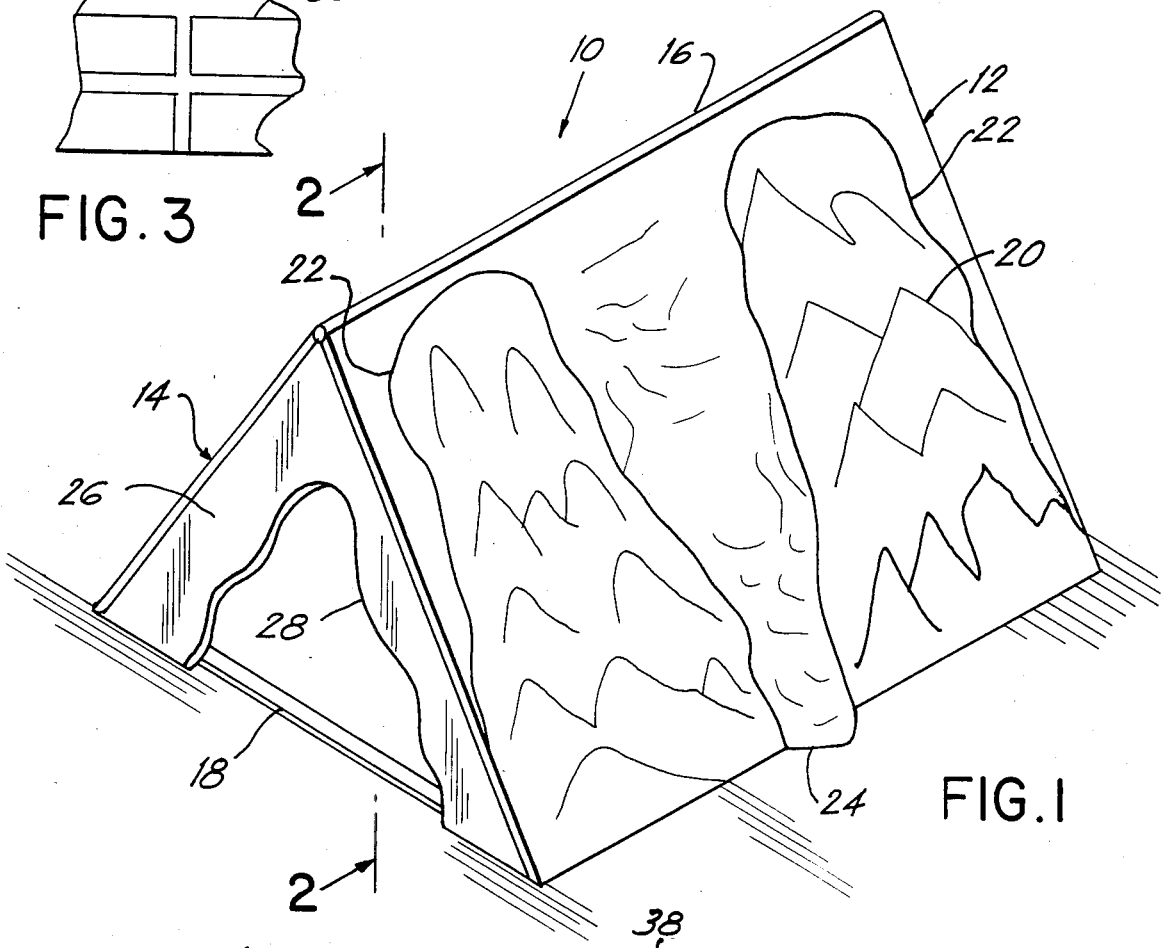
FIG. 1 is a perspective view of the invention.

Turning now descriptively to the drawings, in which similar reference characters denote similar elements throughout the several views, FIG. 1 illustrates an apparatus 10 for climbing and sliding. The apparatus 10 consists of a first panel 12, a second panel 14, a hinge member 16 and brace members 18.

The first panel 12 has an irregular surface 20 forming a plurality of hand and toe holds so that a child (not shown) can climb thereupon. The irregular surface 20 simulates craggy mountains 22 for a hard climb and a valley 24 for a easy climb.

The second panel 14 has a smooth flat surface so that the child can slide thereupon. A picture can be placed on the flat surface. For example the picture could have mountains in the background, a lake or some water, some trees in the foreground, a few animals standing by the water with one drinking and some birds on the branches.

The hinge member 16 connects inner ends of the first panel 12 and the second panel 14 together. The brace members 18 interconnect outer ends of the first panel 12 and the second panel 14 so that the panels may be set up in inclined positions.

A pair of triangular cave panels 26 are also provided. Each cave panel 26 has an opening 28 and is connected to side ends of the first panel 12 and the second panel 14 so that the child can crawl therethrough.

The panel 12 may be provided with a horizontal top portion hinged to the panel 14 providing a top sitting area.

Figure 3:
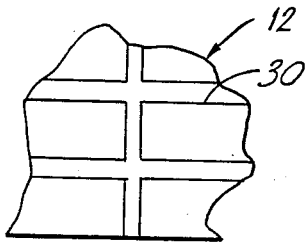
FIG. 3 is a partial side view showing the slot patterns.
Figure 2:
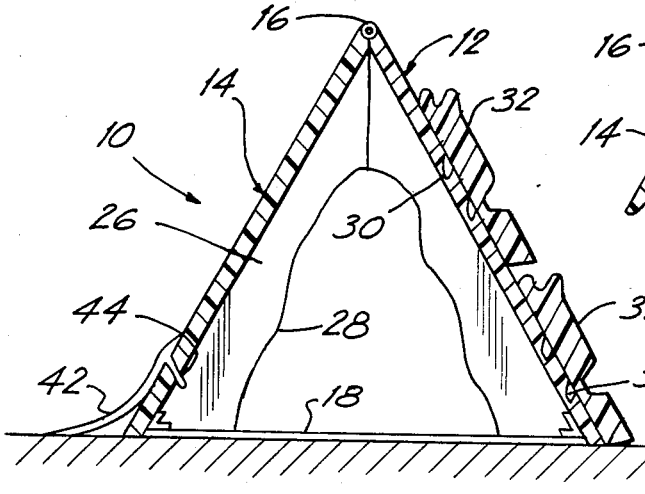
FIG. 2 is a cross sectional view taken along line 2—2 in FIG. 1.

FIGS. 2 and 3 show the first panel 12 further having a plurality of horizontal and vertical interconnecting slots 30. A plurality of hand and toe gripping members 32 are also provided. Each hand and toe gripping member 32 has pins 34 extending therefrom to slide within the slots 30 so that the pattern of the hand and toe gripping members can be varied.

Figure 4:
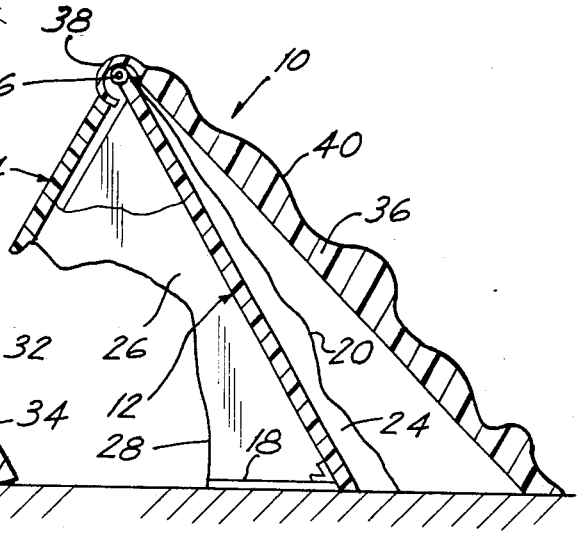
FIG. 4 is a cross sectional view similar to FIG. 2 with parts broken away showing a valley climbing platform attached thereto.

FIG. 4 shows an elongated valley climbing platform 36 that has a curved inner end 38 attachable to the hinge member 16. The valley climbing platform 36 is at a less step incline so that the child will have an easier time in climbing up to the hinge member 16. The valley climbing platform 36 also has an irregular surface 40 making it easier for the child to climb.

A bottom curved slide member 42 (see FIG. 2) is attachable at 44 to lower portion of the second panel 14 so that when the child slides down the second panel the bottom curved slide member 42 will gently ease the child off of the second panel 14.

The apparatus 10 can be made out of rigid plastic, metal, wood or any other durable material that will hold up over a long period of time. When the apparatus 10 is not being used it can be folded up for storage.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. Apparatus for climbing and sliding which comprises:

(a) a first panel having an irregular surface forming a plurality of hand and toe holds so that a child can climb thereupon;

(b) a second panel having a smooth flat surface so that said child can slide thereupon;

(c) a hinge member connecting inner ends of said first panel and said second panel together; and (d) at least one brace member interconnecting outer ends of said first panel and said second panel so that said panels may be set up in inclined positions, wherein said irregular surface of said first panel simulates craggy mountains for a hard climb and a valley for an easy climb, further comprising a pair of triangular cave panels, each said cave panel having an opening and connected to side ends of said first panel and said second panel so that said child can crawl therethrough, further comprising:

(e) said first panel having a plurality of horizontal and vertical interconnecting slots; and (f) a plurality of hand and toe gripping members, each hand and toe gripping member having pins extending therefrom to slide within said slots so that the pattern of said hand and toe gripping members can be varied so as to vary said irregular surface.

2. The apparatus as recited in claim 1, further comprising an elongated valley climbing platform having a curved inner end attachable to said hinge member said valley climbing platform being at a less steep incline so that the child will have an easier time in climbing up to said hinge member.

3. The apparatus as recited in claim 2, further comprising a bottom curved slide member attachable to lower portion of said second panel so that when said child slides down said second panel said bottom curved slide member will gently ease said child off of said second panel.

* * * * *